US009251751B2

(12) United States Patent
Shin et al.

(10) Patent No.: US 9,251,751 B2
(45) Date of Patent: Feb. 2, 2016

(54) DISPLAY DEVICE AND METHOD OF DRIVING THE SAME UTILIZING KICKBACK COMPENSATION VALUES

(71) Applicant: Samsung Display Co., Ltd., Yongin (KR)

(72) Inventors: Seung-Woon Shin, Asan-si (KR); Kihyun Pyun, Goyang-si (KR); Jun-Ho Hwang, Asan-si (KR); Jang-Mi Lee, Busan (KR)

(73) Assignee: Samsung Display Co., Ltd., Yongin-si (KR)

( * ) Notice: Subject to any disclaimer, the term of this patent is extended or adjusted under 35 U.S.C. 154(b) by 73 days.

(21) Appl. No.: 14/182,805

(22) Filed: Feb. 18, 2014

(65) Prior Publication Data

US 2015/0035818 A1 Feb. 5, 2015

(30) Foreign Application Priority Data

Aug. 2, 2013 (KR) ..... 10-2013-0092190

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01); *G09G 2310/0286* (2013.01); *G09G 2320/0242* (2013.01); *G09G 2320/0285* (2013.01); *G09G 2330/10* (2013.01)

(58) Field of Classification Search
CPC ..... G09G 2310/08; G09G 3/3688
USPC ..... 345/99, 100
See application file for complete search history.

(56) References Cited

U.S. PATENT DOCUMENTS

| | | | | |
|---|---|---|---|---|
| 7,920,113 | B2 * | 4/2011 | Um et al. | 345/87 |
| 8,044,914 | B2 * | 10/2011 | Lee et al. | 345/98 |
| 2007/0097061 | A1 * | 5/2007 | Kurita | 345/99 |
| 2007/0103420 | A1 * | 5/2007 | Chao et al. | 345/98 |
| 2008/0055226 | A1 * | 3/2008 | Huang et al. | 345/100 |
| 2008/0198122 | A1 | 8/2008 | Shin et al. | |
| 2009/0115761 | A1 * | 5/2009 | Shih et al. | 345/211 |
| 2010/0053183 | A1 * | 3/2010 | Park | 345/536 |

FOREIGN PATENT DOCUMENTS

| | | |
|---|---|---|
| JP | 2011-123470 | 6/2011 |
| KR | 10-2007-0120279 | 12/2007 |
| KR | 10-2008-0070221 | 7/2008 |
| KR | 10-2010-0061301 | 6/2010 |

* cited by examiner

*Primary Examiner* — Roy Rabindranath
(74) *Attorney, Agent, or Firm* — H. C. Park & Associates, PLC

(57) ABSTRACT

A display device includes gate lines, data lines, pixels, a gate driver, a data driver, and a timing controller. The gate lines extend in a first direction. The data lines extend in a second direction crossing the first direction. Each of the pixels is connected to a corresponding gate line of the gate lines and a corresponding data line of the data lines. The gate driver is configured to drive the gate lines. The data driver is configured to drive each data line of the data lines in response to a corresponding data signal. The timing controller is configured to, in response to an image signal and a control signal, apply the corresponding data signals to the data driver and control the gate driver. Each corresponding data signal reflects a kickback compensation value corresponding to a distance between the gate driver and the corresponding data line in the first direction.

16 Claims, 10 Drawing Sheets

Fig. 7

LUT

| | DL1 | DL480 | DL960 | DL1440 | DL1920 |
|---|---|---|---|---|---|
| 0 | 0 | 0 | 0 | 0 | 0 |
| 1 | | | | | |
| 2 | | | | | |
| 3 | | | | | |
| ⋮ | ⋮ | ⋮ | ⋮ | ⋮ | ⋮ |
| 128 | 160 | 140 | 128 | 140 | 160 |
| ⋮ | ⋮ | ⋮ | ⋮ | ⋮ | ⋮ |
| 255 | 255 | 230 | 215 | 230 | 255 |

Fig. 10

LUT4

LUT3

LUT2

LUT1

| | DL1 | DL480 | DL960 | DL1440 | DL1920 |
|---|---|---|---|---|---|
| 0 | 0 | 0 | 0 | 0 | 0 |
| 1 | | | | | |
| 2 | | | | | |
| 3 | | | | | |
| ⋮ | ⋮ | ⋮ | ⋮ | ⋮ | ⋮ |
| 128 | 160 | 140 | 128 | 140 | 160 |
| ⋮ | ⋮ | ⋮ | ⋮ | ⋮ | ⋮ |
| 255 | 255 | 230 | 215 | 230 | 255 |

DISPLAY DEVICE AND METHOD OF DRIVING THE SAME UTILIZING KICKBACK COMPENSATION VALUES

CROSS-REFERENCE TO RELATED APPLICATION

This application claims priority from and the benefit of Korean Patent Application No. 10-2013-0092190, filed on Aug. 2, 2013, which is incorporated by reference for all purposes as if set forth herein.

BACKGROUND

1. Field

Exemplary embodiments relate to display technology, and, more particularly, to a display device with improved display quality and a method of driving the same.

2. Discussion

Conventional display devices typically include a display panel to display an image, as well as a data driver and a gate driver to drive the display panel. The display panel may include gate lines, data lines, and pixels. Each pixel of, for example, a liquid crystal display device, usually includes at least one of a thin film transistor, a liquid crystal capacitor, and a storage capacitor. The data driver may be configured to apply a data driving signal to the data lines and the gate driver may be configured to apply a gate driving signal to the gate lines. In this manner, the display device may apply a gate on voltage to a gate electrode of the thin film transistor connected to the gate line connected to a pixel in which the image is displayed, and apply a data voltage, which corresponds to the image, to a source electrode of the thin film transistor to display the image.

It is noted that the voltage charged in the liquid crystal capacitor and the storage capacitor when the thin film transistor is turned on is typically maintained for a determined time after the thin film transistor is turned off. Due to a parasitic capacitance that may exist between a gate electrode and a drain electrode of the thin film transistor when the display panel is being manufactured, however, may result in a gray-scale voltage applied to the liquid crystal capacitor and the storage capacitor that may be distorted. That is, a difference may occur between the gray-scale voltage output from the data driver and the gray-scale voltage applied to the liquid crystal capacitor and the storage capacitor. This distorted voltage may be referred to as a kickback voltage. As the kickback voltage becomes larger and a difference between kickback voltages of the thin film transistors become larger, display quality of the image displayed in the display panel may proportionally deteriorate (or otherwise degrade).

It is also recognized that the gate signal output from the gate driver may be delayed as the display panel becomes larger in size and adopts a high-speed driving method. To this end, a waveform of the gate signal may be gradually altered. In this manner, the kickback voltage of a first pixel located relatively farther away from the gate driver than a second pixel may become lower than that of the second pixel, which is located relatively closer to the gate driver. As such, the rate of charging the liquid crystal capacitor associated with the respective pixels may be changed, which, in turn, may cause the image to become non-uniform.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device with improved display quality, and a method of driving the same.

Additional aspects will be set forth in the detailed description which follows and, in part, will be apparent from the disclosure, or may be learned by practice of the inventive concept.

According to exemplary embodiments, a display device includes: gate lines, data lines, pixels, a gate driver, a data driver, and a timing controller. The gate lines extend in a first direction. The data lines extend in a second direction crossing the first direction. Each of the pixels is connected to a corresponding gate line of the gate lines and a corresponding data line of the data lines. The gate driver is configured to drive the gate lines. The data driver is configured to drive each data line of the data lines in response to a corresponding data signal. The timing controller is configured to, in response to an image signal and a control signal, apply the corresponding data signals to the data driver and controls the gate driver. Each corresponding data signal reflects a kickback compensation value corresponding to a distance between the gate driver and the corresponding data line in the first direction.

According to exemplary embodiments, a method includes: receiving a first signal associated with driving a pixel connected to a data line; retrieving a first kickback voltage compensation value based on the first signal and the relative position of the data line with respect to a plurality of data lines; and generating a second signal based on the first kickback voltage compensation value to drive the pixel via the data line.

According to exemplary embodiments, kickback voltage compensation may be performed on a data signal based on a distance between the gate driver and corresponding data lines to output a modified data signal to drive the display panel. In this manner, display quality of the display device may be improved.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIG. 7 is a look-up table, according to exemplary embodiments.

FIG. 10 is a look-up table utilized to compensate for variation in kickback voltage in a first direction and variation of kickback voltage in a second direction, according to exemplary embodiments.

DETAILED DESCRIPTION OF THE ILLUSTRATED EMBODIMENTS

Figure 1:
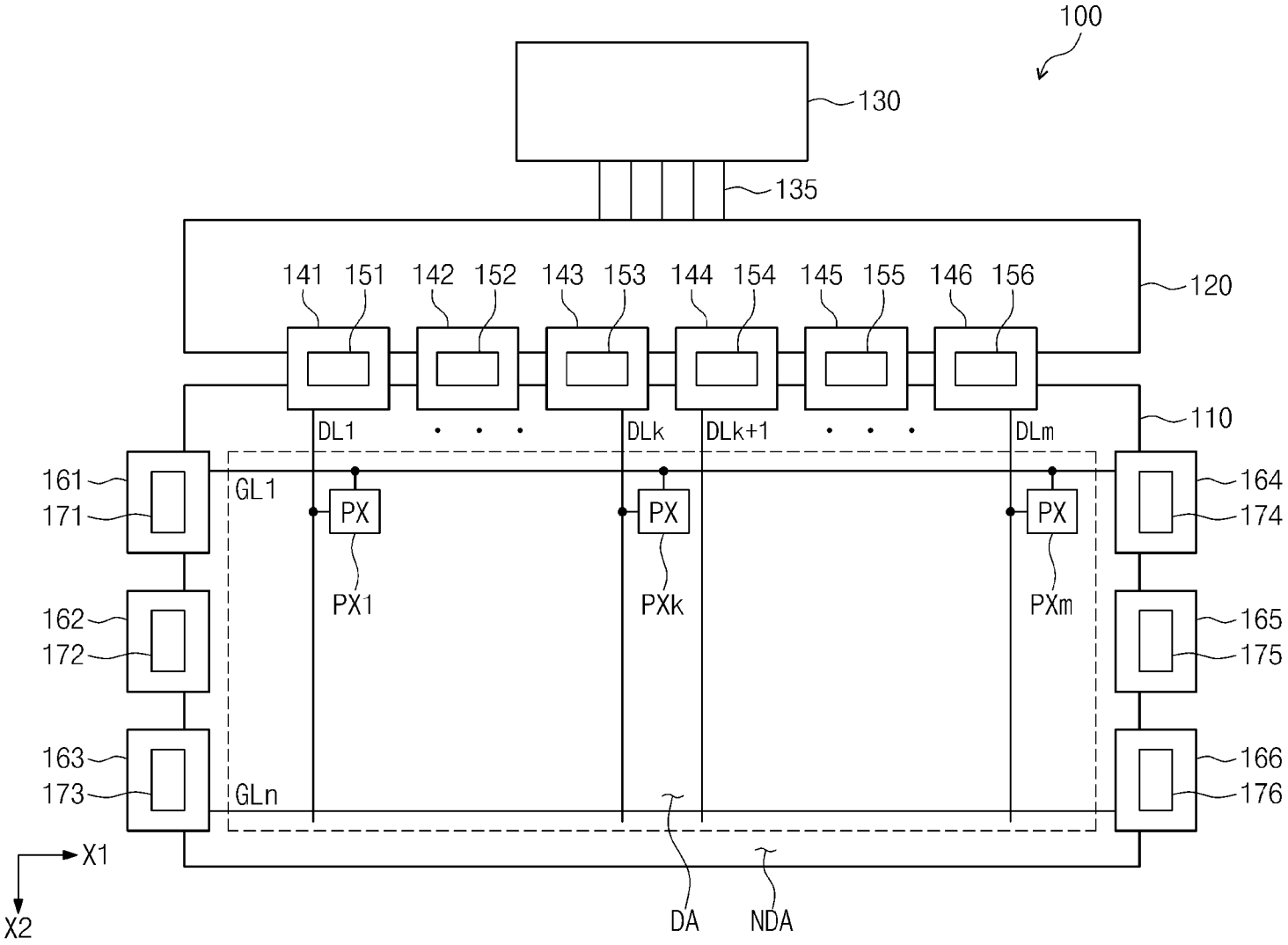
FIG. 1 is a plan view of a display device, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a plan view of a display device, according to exemplary embodiments.

Referring to FIG. 1, the display device 100 may include a display panel 110, a printed circuit board 120, a controller 130, a plurality of data driving circuits (e.g., data driving circuits 141 to 146), and a plurality of gate driving circuits (e.g., gate driving circuits 161 to 166). Although specific reference will be made to this particular implementation, it is also contemplated that the display device 100 may embody many forms and include multiple and/or alternative components. For example, it is contemplated that the components of the display device 100 may be combined, located in separate structures, and/or separate locations.

According to exemplary embodiments, the display panel 110 may include a display area DA in which pixels PX are arranged and a non-display area NDA disposed adjacent to the display area DA, such as surrounding the display area DA. In this manner, an image may be displayed via the display area DA and may not be displayed via the non-display area NDA. It is noted that the display panel 110 may include a glass substrate, a silicon substrate, a film substrate, or any other suitable substrate.

The printed circuit board 120 may include various circuits to drive the display panel 110. The printed circuit board 120 may include a plurality of lines connected to the controller 130, the data driving circuits 141 to 146, and the gate driving circuits 161 to 166. It is noted that although FIG. 1 illustrates six data driving circuits 141 to 146 and six gate driving circuits 161 to 166, it is contemplated that display device 100 may include any suitable number of data driving circuits and/or gate driving circuits. To this end, the number of data driving circuits may or may not be equal to the number gate driving circuits.

As seen in FIG. 1, the controller 130 may be electrically connected to the printed circuit board 120 via a cable 135 or any other suitable connector. It is also contemplated that the controller 130 may be directly mounted on the printed circuit board 120. In exemplary embodiments, the controller 130 may apply a data signal DATA (such as the data signal depicted in FIG. 5) and a first control signal CONT1 (such as the first control signal illustrated in FIG. 5) to the data driving circuits 141 to 146 via the cable 135. Further, the controller 130 may be configured to apply a second control signal CONT2 (such as the second control signal shown in FIG. 5) to the gate driving circuits 161 to 166. The first control signal CONT1 may include a horizontal synchronization start signal, a clock signal, and a line latch signal, as well as any other suitable signal. The second control signal CONT2 may include a vertical synchronization start signal, an output enable signal, and a gate pulse signal, as well as any other suitable signal.

According to exemplary embodiments, each of the data driving circuits 141 to 146 may be implemented as a tape carrier package (TCP), a chip on film (COF), or any other suitable configuration. In this manner, the data driving circuits 141 to 146 may respectively include data driving integrated circuits 151 to 156 respectively mounted thereon or otherwise coupled thereto. It is also contemplated that the data driving integrated circuits 151 to 156 may be mounted on the display panel 110 rather than the printed circuit board 120. Each of the data driving integrated circuits 151 to 156 may be configured to drive a corresponding one of the data lines DL1 to DLm (where "m" is a real number greater than zero) in response to the data signal DATA and the first control signal CONT1 received from, for example, the controller 130.

The data driving circuits 141 to 146 may be disposed at (or near) a first side of the display panel 110 and may be sequentially arranged in a first direction X1, e.g., spaced apart from one another in the first direction X1. The gate driving circuits 161 to 166 may be disposed at (or near) a second side and a third side of the display panel 110. For instance, first ones of the gate driving circuits (e.g., gate driving circuits 161, 162, and 163) may be disposed at the second side of the display panel 110 and may be sequentially arranged in a second direction X2 crossing the first direction X1, e.g., perpendicular (or substantially perpendicular) to the first direction X1. Second ones of the gate driving circuits (e.g., gate driving circuits 164, 165, and 166) may be disposed at the third side of the display panel 110 and may be sequentially arranged in the second direction X2 respectively facing the first ones of the gate driving circuits.

In exemplary embodiments, each of the gate driving circuits 161 and 166 may be implemented as a TCP, a COF, or any other suitable configuration, such as, for example, a circuit made of an oxide semiconductor, an amorphous silicon gate, a crystalline semiconductor, a polycrystalline semiconductor, etc., which may be integrated as part of the non-display area NDA of the display panel 110. In this manner, the gate driving circuits 161 to 166 may respectively include gate driving integrated circuits 171 to 176. It is also contemplated that the gate driving circuits 161 to 166 may be mounted on or otherwise coupled to one or more printed circuit boards. For instance, gate driving circuits 161 to 163 may be mounted on a first printed circuit board, whereas gate driving circuits 164 to 166 may be mounted on a second printed circuit board.

According to exemplary embodiments, the gate driving circuits 161 to 166 may be configured to drive gate lines GL1 to GLn (where "n" is a real number greater than zero) in response to the second control signal CONT2 received from, for instance, the controller 130. In this manner, when a gate on voltage is applied to a gate line, thin film transistors of corresponding pixels PX arranged in a row and connected to the gate line may be turned on. As such, the data driving integrated circuits 151 to 156 may apply data driving signals corresponding to the data signal DATA to the data lines DL1 to DLm. That is, the data driving signals applied to the data lines DL1 to DLm may be applied to the corresponding pixels PX that are turned-on via the gate on voltage. It is noted that a period in which the thin film transistors of the corresponding pixels PX arranged in the row are turned on may be referred to as a "one horizontal period" or "1H."

Figure 5:
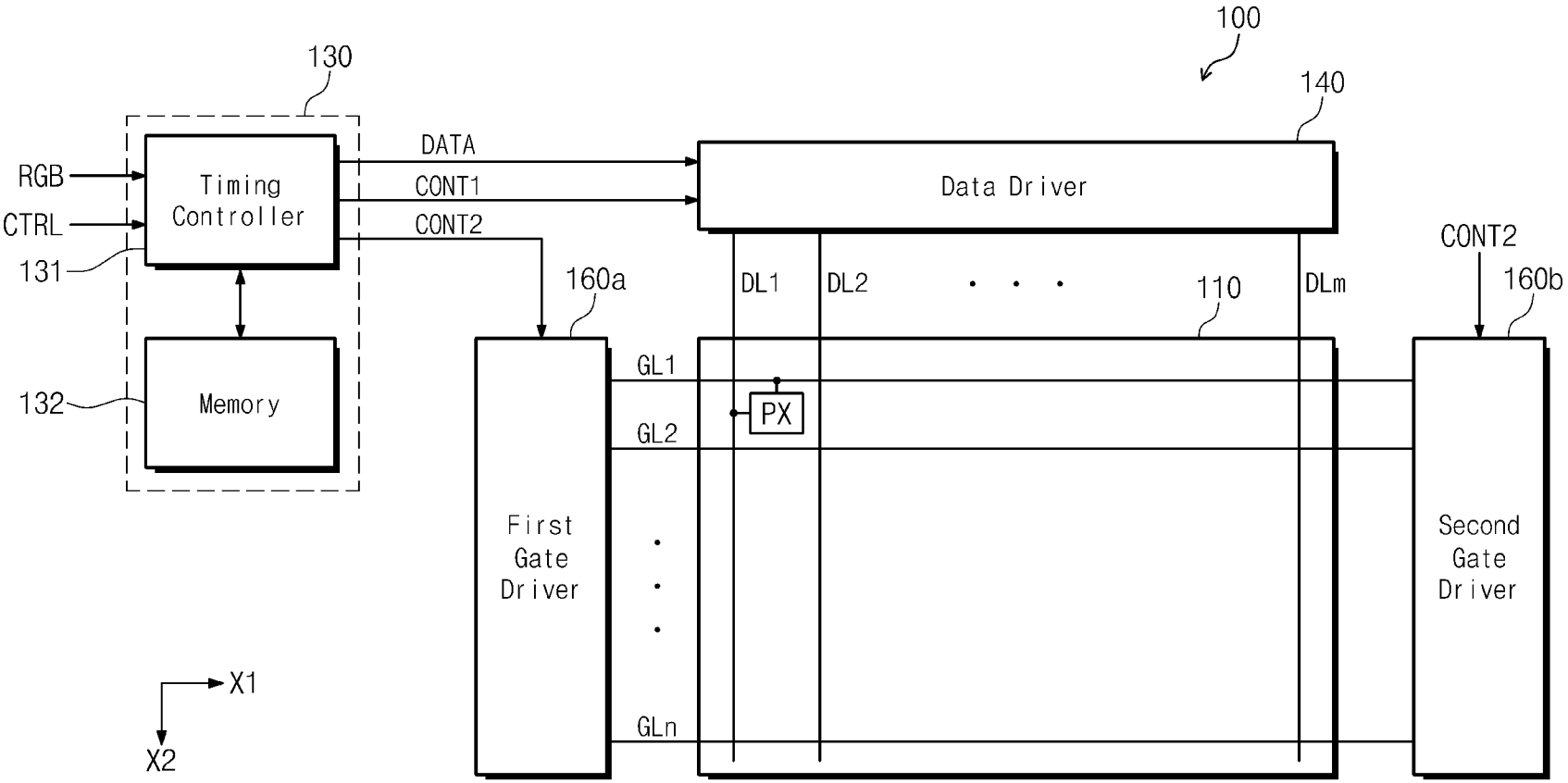
FIG. 5 is a block diagram of the display device of FIG. 1, according to exemplary embodiments.
Figure 6:
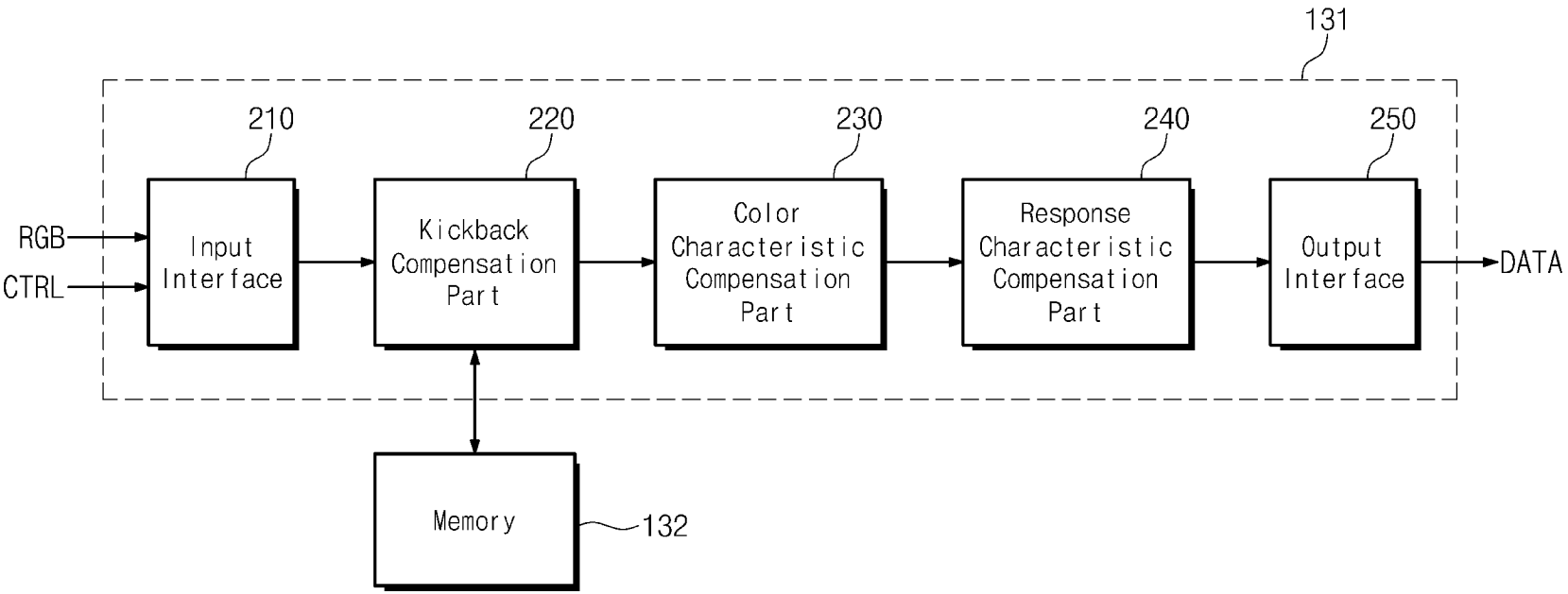
FIG. 6 is a block diagram of a controller of the display device of FIG. 5, according to exemplary embodiments.

It is noted that various components of display device 100 are described in more detail in association with FIGS. 5-7.

Figure 2:
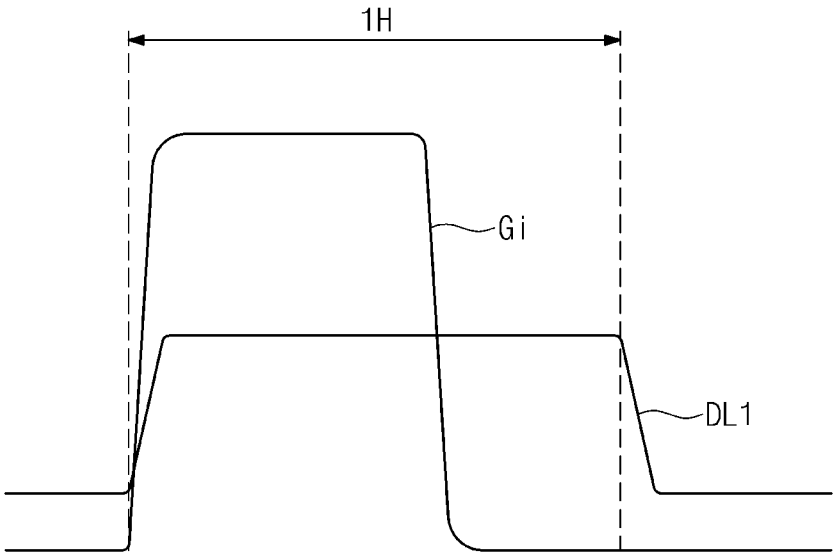
FIGS. 2 and 3 are respective waveform diagrams of corresponding relations between a gate driving signal and a data driving signal, according to exemplary embodiments.
Figure 3:
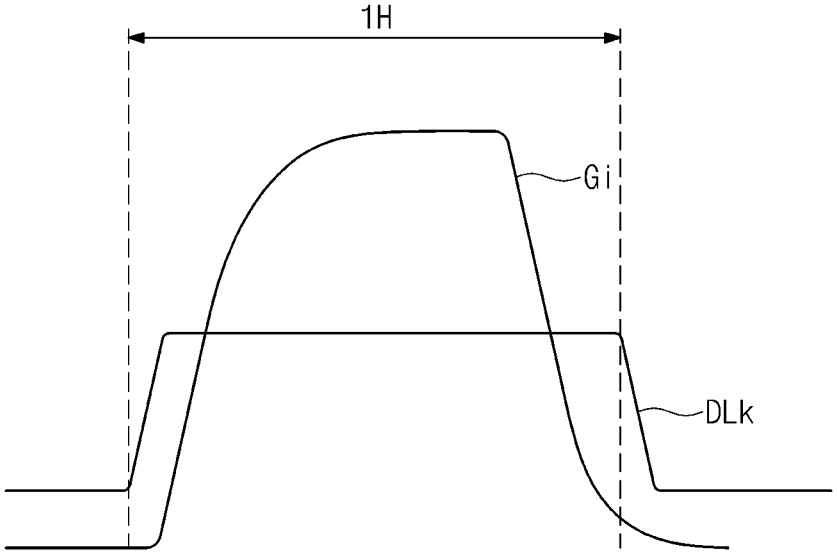

FIGS. 2 and 3 are respective waveform diagrams of corresponding relations between a gate driving signal and a data driving signal, according to exemplary embodiments. In particular, FIG. 2 shows a relation between a gate driving signal and a data driving signal applied to a data line disposed adjacent to the gate driving circuits of the display device of FIG. 1, whereas FIG. 3 shows a relation between a gate driving signal and a data driving signal applied to a data line disposed relatively farther away from the gate driving circuits of the display device of FIG. 1.

Referring to FIGS. 2 and 3, the gate signal Gi generated by the gate driving circuits 161 to 166 may be transmitted through an i-th gate line GLi (where "i" is a natural number greater than zero) of the gate lines GL1 to GLn. In this manner, the gate signal Gi generated by a gate driving circuit (such as gate driving circuit 161) may be delayed as it reaches various ones of the pixels PX. As such, the rising and falling edges of the gate signal Gi may become more curved as the gate signal Gi is applied to pixels disposed farther away from the gate driving circuits in the first direction X1. For instance, as seen in FIG. 2, the extent of the curved rising and falling edges of the gate signal Gi are much less drastic than, as seen in FIG. 3, the gate signal Gi applied to the k-th pixel PXk connected to the k-th data line DLk (where "k" is a natural number greater than zero) of the data lines DL1 to DLm. Due to the variation in the waveforms of the gate signal Gi applied to the various pixels PX, respective amounts of parasitic capacitance generated between the gate electrode and the drain electrode of the thin film transistor associated with each pixel PX may be determined based on the respective positions of the pixels in the first direction X1.

Figure 4:
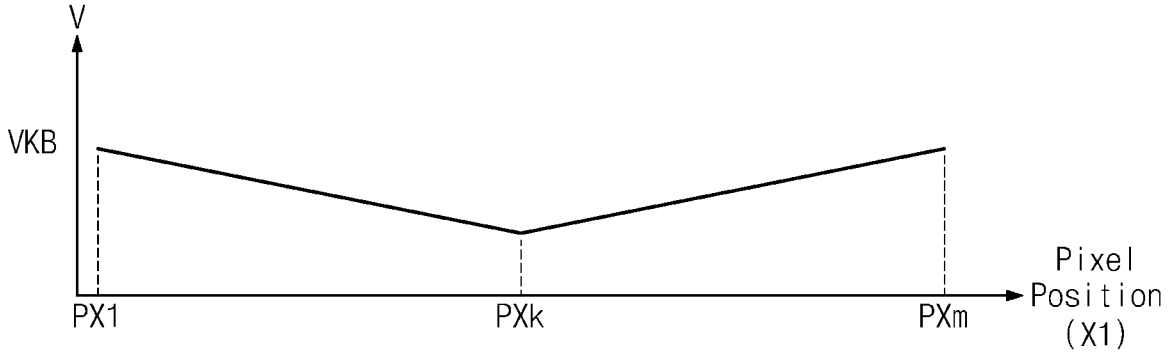
FIG. 4 is a plot of variation in kickback voltage as a function of a position of a pixel in a display panel, according to exemplary embodiments.

FIG. 4 is a plot of variation of a kickback voltage as a function of a position of a pixel in a display panel, according to exemplary embodiments.

Referring to FIGS. 1 and 4, among the pixels PX connected to an i-th gate line GLi (e.g., gate line G1), the kickback voltage VKB of the pixels PX1 and PXm disposed adjacent to the gate driving circuits 161 to 166 may be higher than the kickback voltage VKB of the pixel PXk disposed farthest away from the gate driving circuits 161 to 166. As such, even though the data driving integrated circuits 151 to 156 apply the same data signal to the data lines DL1 to DLm, the charge rate of the respective liquid crystal capacitors of the pixels PX may vary when the kickback voltage VKB is altered according to the corresponding positions of the pixels PX. For instance, the charge rate of the pixels PX1 and PXm disposed adjacent to the gate driving circuits 161 to 166 in the first direction X1 may become lower than that of the pixel PXk disposed farthest away from the gate driving circuits 161 to 166.

FIG. 5 is a block diagram of the display device of FIG. 1, according to exemplary embodiments.

Referring to FIG. 5, the display device 110 may include the display panel 110, the controller 130, a data driver 140, and gate drivers 160*a* and 160*b*.

The display panel 110 may include the data lines DL1 to DLm, the gate lines GL1 to GLn crossing the data lines DL1 to DLm, and the pixels PX arranged in areas defined in association with the data lines DL1 to DLm and the gate lines GL1 to GLn. The data lines DL1 to DLm may be insulated from the gate lines GL1 to GLn. Although not illustrated, each of the pixels PX may include a thin film transistor connected to a corresponding data line of the data lines DL1 to DLm and a corresponding gate line of the gate lines GL1 to GLn, a liquid crystal capacitor connected to the thin film transistor, and a storage capacitor connected to the thin film transistor.

According to exemplary embodiments, the controller 130 may include a timing controller 131 and a memory 132. The timing controller 131 may be configured to receive an image signal RGB and control signals CTRL, such as a vertical synchronization signal, a horizontal synchronization signal, a main clock signal, a data enable signal, etc., to control a display of the image signal RGB, which may be received from, for example, a source, such as an external source. The timing controller 131 may be configured to convert a data format of the image signal RGB to a data format utilized to drive the display panel 110 based on the control signals CTRL. In this manner, the timing controller may output the data signal DATA and the first control signal CONT1 to the data driver 140, as well as output the second control signal CONT2 to the gate drivers 160*a* and 160*b*. The first control signal CONT1 may include the horizontal synchronization start signal, the clock signal, and the line latch signal, and the second control signal CONT2 may include the vertical synchronization start signal, the output enable signal, and the gate pulse signal. It is contemplated, however, that the first and second control signals CONT1 and CONT2 may include any other or additional signal. The timing controller 131 may be configured to apply the data signal DATA, to which a kickback compensation value reflected based on information stored to the memory 132, to the data driver 140.

The first and second gate drivers 160*a* and 160*b* may be configured to drive the gate lines GL1 to GLn in response to receiving the second control signal CONT2 from, for example, the timing controller 131. The first gate driver 160*a* may include the gate driving circuits 161 to 163 and the second gate driver 160*b* may include the gate driving circuits 164 to 166. The data driver 140 may be configured to output gray-scale voltages to drive the data lines DL1 to DLm in response to receiving the data signal DATA and the first control signal CONT1 from, for instance, the timing controller 131.

In exemplary embodiments, the controller 130, the data driver 140, and first and second gate drivers 160*a* and 160*b*, and/or one or more components thereof (such as the timing controller 131 of the controller 130), may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, and/or processes described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the controller 130, the data driver 140, and first and second gate drivers 160*a* and 160*b*, and/or one or more components thereof may include or otherwise be associated with one or more memories 132 including code (e.g., instructions) configured to cause the controller 130, the data driver 140, and first and second gate drivers 160*a* and 160*b*, and/or one or more components thereof to perform one or more of the features, functions, and/or processes described herein.

The memory 132 may be any medium that participates in providing code/instructions to the one or more software, hardware, and/or firmware components for execution. Such memories 132 may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

FIG. 6 is a block diagram of a controller of the display device of FIG. 5, according to exemplary embodiments.

Referring to FIG. 6, the timing controller 131 may include an input interface 210, a kickback compensation part (or module) 220, a color characteristic compensation part (or module) 230, a response characteristic compensation part (or module) 240, and an output interface 250.

The input interface 210 may be configured to receive the image signal RGB and the control signals CTRL from a source, such as an external source (not shown). The input interface 210 may convert a low voltage differential signaling (LVDS) signal to a transistor to transistor logic (TTL) signal.

The kickback compensation part 220 may be configured to output the image signal RGB received via the input interface 210 as a kickback compensation signal, which may reflect the kickback compensation value. In exemplary embodiments, the kickback compensation part 220 may interface with the memory 132, which may store kickback compensation signals corresponding to the image signal RGB and the position of the pixel in which the image signal RGB is to be displayed. The kickback compensation signals stored in the memory 132 may be stored in a look-up table form; however, any other suitable storage architecture may be utilized in association with exemplary embodiments described herein. The kickback compensation part 220 may convert the image signal RGB to the kickback compensation signal based on information retrieved (or otherwise received) from the memory 132.

The color characteristic compensation part 230 may be configured to perform ACC (accurate color capture) compensation to improve the color characteristic of the kickback compensation signal output from the kickback compensation part 220. The ACC compensation may be used to increase the number of gray-scale levels without increasing the number of bits of the image signals RGB. It is noted, however, that any other and/or additional color compensation/correction techniques may be utilized in association with exemplary embodiments described herein, such as, for example, color correction, color grading, etc.

The response characteristic compensation part 240 may be configured to perform a dynamic capacitance capture in order to improve a response speed of the image displayed via the display panel 110. The response characteristic compensation part 240 may output a signal, in which the response speed is compensated on the basis of a difference between a present signal output from the color characteristic compensation part 230 and a previous signal, as the data signal DATA. In this manner, the data signal DATA may be applied to the data driver 140 via the output interface 250.

FIG. 7 is the look-up table, according to exemplary embodiments. It is noted that the look-up table may be stored in memory 132 of FIG. 6, or any other suitable storage device of or accessible to the display device 100.

Referring to FIG. 7, gray-scale values of the image signal RGB may be represented in a vertical direction of the look-up table LUT and positions in the first direction X1 of the pixels PX in which the image signal RGB is displayed may be represented in a horizontal direction. That is, the look-up table LUT may be used to convert the image signal RGB to the kickback compensation signal on the basis of the positions in the first direction X1 of the pixels PX in which the image signal RGB is displayed. It is noted that the positions in the first direction X1 of the pixels PX in which the image signal RGB is displayed may be indicated by the associated data lines to which the pixels PX are connected. Further, it is noted that the values in the look-up table LUT are merely illustrative.

According to exemplary embodiments, the number of the data lines DL1 to DLm of the display panel 110 may be 1920; however, the look-up table LUT includes kickback compensation signals of the pixels PX respectively connected to a subset of reference data lines, such as five reference data lines DL1, DL480, DL960, DL1440, and DL1920 among the data lines DL1 to DLm. It is noted, however, that the display panel 110 may include any suitable number of data lines, as well as any suitable number of stored reference data line kickback compensation values. The kickback compensation part 220 shown in FIG. 6 may generate the kickback compensation signal of the pixels PX connected to other data lines DL except for the five reference data lines DL1, DL480, DL960, DL1440, and DL1920 among the data lines DL1 to DLm by interpolating the kickback compensation signals based on the kickback compensation signals of two adjacent reference data lines provided in the look-up table LUT.

For instance, the kickback compensation signal of the pixel PX connected to the data line DL550 when the gray-scale value of the image signal RGB is 128 may be determined by the kickback compensation part 220 retrieving (or otherwise receiving) the kickback compensation signals 140 and 128 of the reference data lines DL480 and DL960, which are adjacent to the data line DL550, from the look-up table LUT stored in the memory 132. The kickback compensation part 220 may generate the kickback compensation signal of the pixel connected to the data line DL550 by interpolating the read-out kickback compensation signals 140 and 128. It is noted that any suitable interpolation scheme may be utilized, such as, for instance, linear interpolation, polynomial interpolation, spline interpolation, Gaussian process-based interpolation, etc.

As shown in FIG. 7, when the gray-scale value of the image signal RGB is 128, the kickback compensation signal applied to the pixel connected to the reference data line DL1 is 160 and the kickback compensation signal applied to the pixel connected to the reference data line DL960 is 128. That is, the kickback compensation signals applied to the pixels PX disposed adjacent to the gate drivers 160*a* and 160*b* have gray-scale values higher than the gray-scale values of the kickback compensation signal applied to the pixel(s) PX disposed farthest away from the gate drivers 160*a* and 160*b*. In this manner, the charge rate of the pixels PX disposed adjacent to the gate drivers 160*a* and 160*b* may be prevented from becoming lower than the charge rate of the pixels PX disposed farther away from the gate drivers 160*a* and 160*b*, which would otherwise be caused by the kickback voltage of the pixels PX disposed adjacent to the gate drivers 160*a* and 160*b* being higher than that of the pixels PX disposed farther away from the gate drivers 160*a* and 160*b*.

Figure 8:
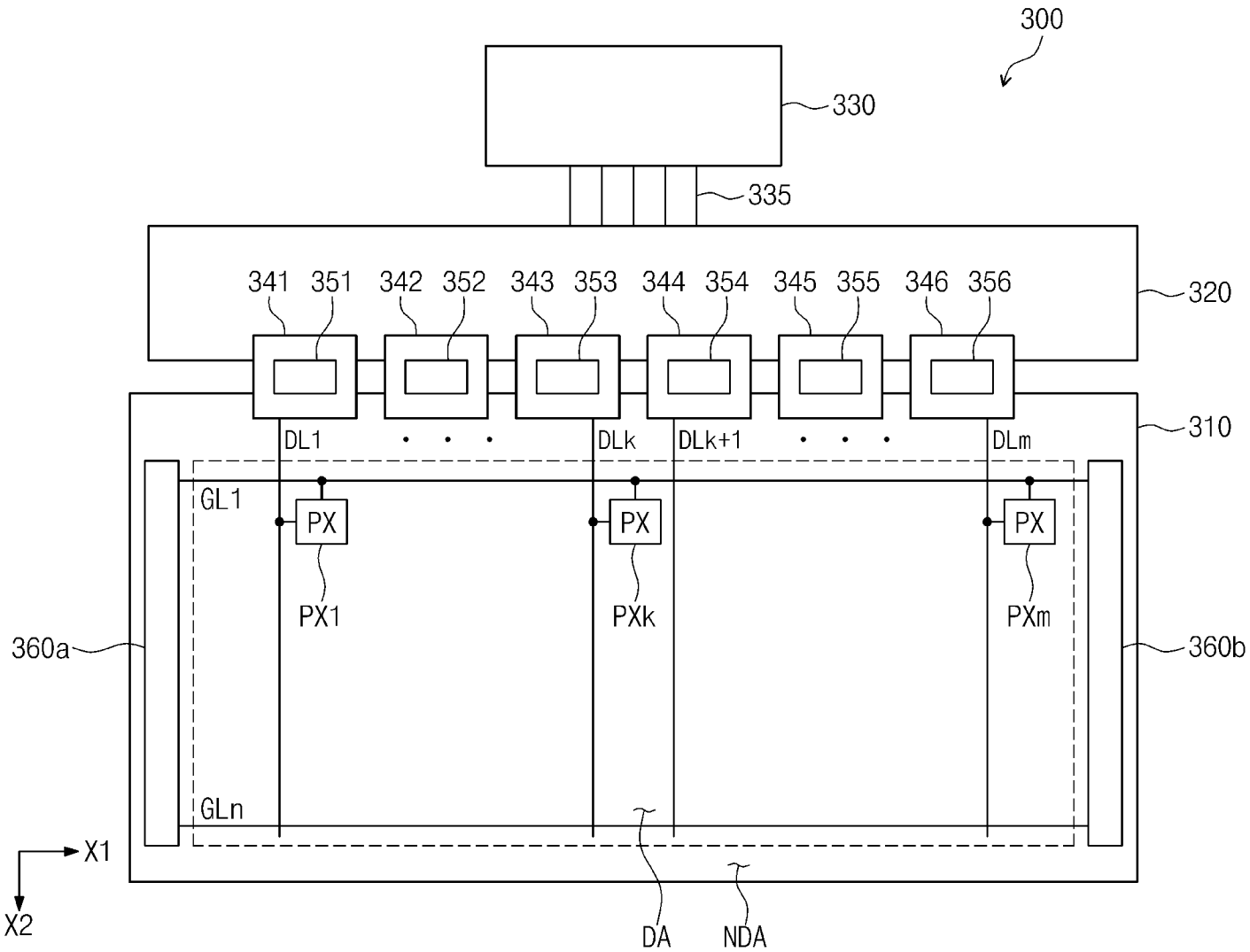
FIG. 8 is a plan view of a display device, according to exemplary embodiments.

FIG. 8 is a plan view of a display device, according to exemplary embodiments.

Referring to FIG. 8, a display device 300 may include a display panel 310, a printed circuit board 320, a controller 330, a plurality of data driving circuits 341 to 346, and gate driving circuits 360*a* and 360*b*. Although specific reference will be made to this particular implementation, it is also contemplated that the display device 300 may embody many forms and include multiple and/or alternative components. For example, it is contemplated that the components of the display device 300 may be combined, located in separate structures, and/or separate locations.

According to exemplary embodiments, the display panel 310 may include a display area DA in which pixels PX are arranged and a non-display area NDA disposed adjacent to the display area DA, such as surrounding the display area DA. In this manner, an image may be displayed via the display area DA and may not be displayed via the non-display area NDA. It is noted that the display panel 310 may include a glass substrate, a silicon substrate, a film substrate, or any other suitable substrate.

The printed circuit board 320 may include various circuits to drive the display panel 310. The printed circuit board 320 may include a plurality of lines connected to the controller 330, the data driving circuits 341 to 346, and the gate driving circuits 360*a* and 360*b*. It is noted that although FIG. 8 illustrates six data driving circuits 141 to 146 and two gate driving circuits 360*a* to 360*b*, it is contemplated that display device 300 may include any suitable number of data driving circuits and/or gate driving circuits. To this end, the number of data driving circuits may or may not be equal to the number gate driving circuits.

As seen in FIG. 8, the controller 330 may be electrically connected to the printed circuit board 320 via a cable 335 or any other suitable connector. It is also contemplated that the controller 330 may be mounted on or formed as part of the printed circuit board 320. Further, the controller 330 may be configured to apply the data signal DATA and the first control signal CONT1 to the data driving circuits 341 to 346 via the cable 335 and apply the second control signal CONT2 to the gate driving circuits 360*a* and 360*b* via the cable 335. The first control signal CONT1 may include a horizontal synchronization start signal, a clock signal, and a line latch signal, as well as another other suitable signal. The second control signal CONT2 may include a vertical synchronization start signal, an output enable signal, and a gate pulse signal, as well as any other suitable signal.

According to exemplary embodiments, the data driving circuits 341 to 346 may be implemented as a TCP, a COF, or any other suitable configuration. In this manner, the data driving circuits may respectively include data driving integrated circuits 351 to 356 mounted thereon or otherwise coupled thereto. It is also contemplated that the data driving integrated circuits 351 to 356 may be mounted on the display panel 310 rather than the printed circuit board 320. Each of the data driving integrated circuits 351 to 356 may be configured to drive a corresponding one of the data lines DL1 to DLm in response to the data signal DATA and the first control signal CONT1 received from, for example, the controller 330. Further, the data driving circuits 341 to 346 may be disposed at (or near) a first side of the display panel 310 and may be sequentially arranged in a first direction X1, e.g., spaced apart from one another in the first direction X1.

According to exemplary embodiments, the gate driving circuits 360*a* and 360*b* may be implemented as a circuit made of an oxide semiconductor, an amorphous silicon gate, a crystalline semiconductor, a polycrystalline semiconductor, etc., which may be integrated as part of the non-display area NDA of the display panel 310. Further, the gate driving circuits 360*a* to 360*b* may be respectively disposed at a second side and a third side of the display panel 110, which may be disposed on opposing sides of the display area DA of the display panel 310.

According to exemplary embodiments, the gate driving circuits 360*a* and 360*b* may be configured to drive gate lines GL1 to GLn in response to the second control signal CONT2 received from, for instance, the controller 330. In this manner, when a gate on voltage is applied to a gate line, thin film transistors of corresponding pixels PX arranged in a row and connected to the gate line may be turned on. As such, the data driving integrated circuits 351 to 356 may apply data driving signals corresponding to the data signal DATA to the data lines DL1 to DLm. That is, the data driving signals applied to the data lines DL1 to DLm may be applied to the corresponding pixels PX that are turned-on via the gate on voltage. It is noted that a period in which the thin film transistors of the corresponding pixels PX arranged in the row are turned on may be referred to as a "one horizontal period" or "1H."

Figure 9:
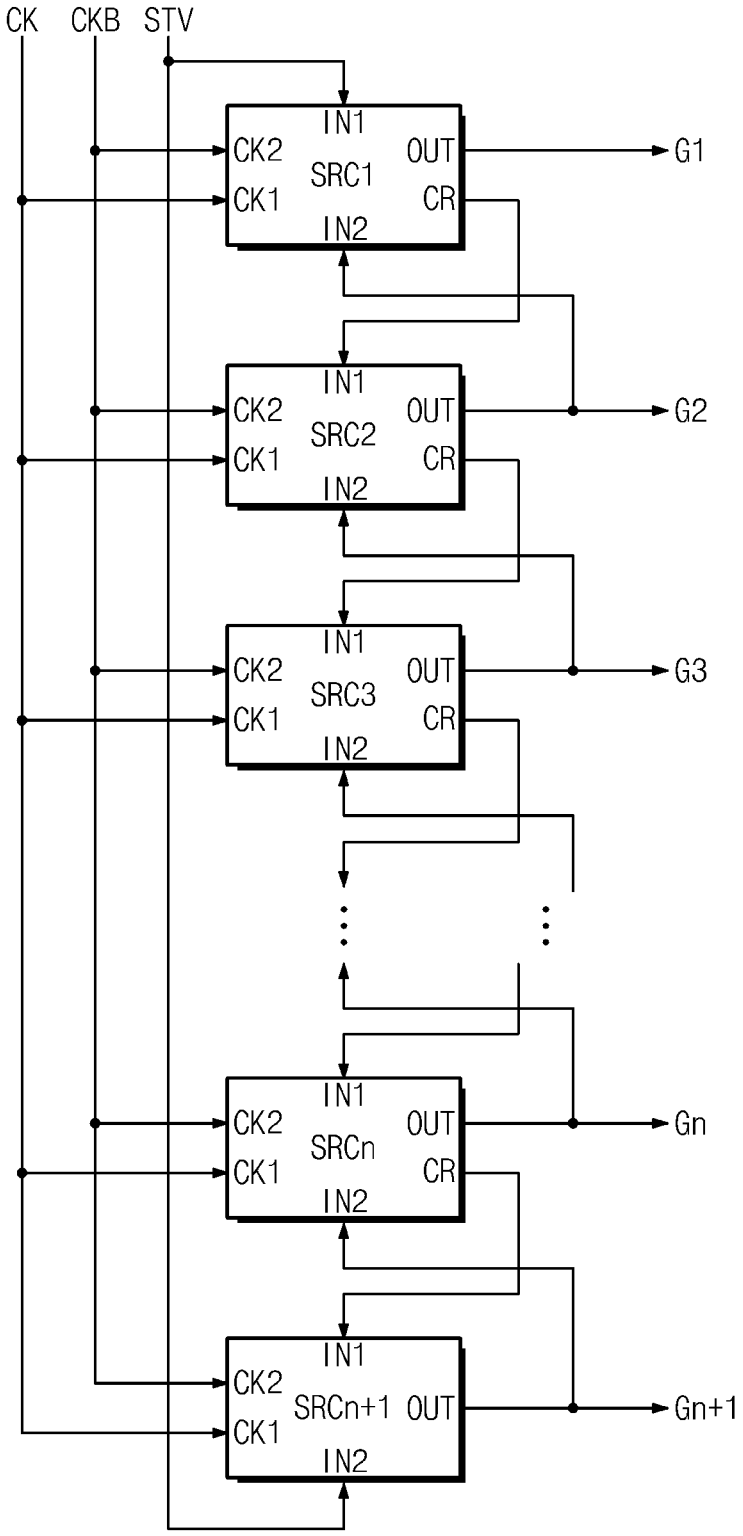
FIG. 9 is a block diagram of a gate driving circuit of the display device of FIG. 8, according to exemplary embodiments.

It is noted that various components of display device 300 are described in more detail in association with FIGS. 9 and 10.

FIG. 9 is a block diagram of a gate driving circuit of the display device of FIG. 8, according to exemplary embodiments.

Referring to FIG. 9, the gate driving circuit 360*a* may include a plurality of stages SRC1 to SRCn+1 connected to one another, one after the other. In other words, adjacent stages may be connected to one another. Each of the stages SRC1 to SRCn may include a first input terminal IN1, a second input terminal IN2, a first clock terminal CK1, a second clock terminal CK2, an output terminal OUT, and a carry terminal CR. The last stage, e.g., stage SRCn+1, may be configured substantially similar to the other stages SRC1 to SRCn, however, stage SRCn+1 may not include a carry terminal CR. The first clock terminal CK1 of the stages SRC1 to SRCn+1 may be configured to receive a first clock signal CK and the second clock terminal CK2 of the stages SRC1 to SRCn+1 may be configured to receive a second clock signal CKB.

The first input terminal IN1 of the stages SRC2 to SRCn+1 may be electrically connected to the carry terminal CR of a previous stage. The first input terminal IN1 of the first stage SRC1, however, may be configured to receive a start pulse signal STV. The second input terminal IN2 of the stages SRC1 to SRCn may be electrically connected to the output terminal OUT of a next stage. The second input terminal IN2 of the last stage SRCn+1, however, may be configured to receive the start pulse signal STV. Further, each of the output terminals OUT of each of the stages SRC1 to SRCn+1 may be connected to a corresponding gate line GL1 to GLn+1.

According to exemplary embodiments, each of the second through n+1-th stages SRC2 to SRCn+1 may be driven in response to receiving a signal from the carry terminal CR of a previous stage, e.g., SRC1 to SRCn. In this manner, gate signals G2 to Gn+1 output from the output terminals OUT of the second through n+1-th stages SRC2 to SRCn+1 may be delayed with respect to the output from the output terminal of the first stage SRC1. The first stage SRC1 may be driven in response to receiving the start pulse signal STV. The delay of the gate signals G2 to Gn+1 may be become greater in the second direction X2 of the display panel 310. As such, the waveform of the gate signals G2 to Gn+1 may be gradually altered from the gate signal G1 output from the first stage SRC1. In exemplary embodiments, however, this gradual altering of the gate signals G2 to Gn+1 may be prevented (or otherwise reduced), as will become more apparent below.

FIG. 10 is a look-up table utilized to compensate for variation in kickback voltage in a first direction and variation of kickback voltage in a second direction, according to exemplary embodiments.

Referring to FIG. 10, the memory 132 (shown in FIG. 6) may be configured to store a plurality of look-up tables, such as, look-up tables LUT1, LUT2, LUT3, and LUT4. It is noted, however, that any suitable number of look-up tables may be provided. When the display panel 310 (shown in FIG. 8) is divided into four groups along the second direction X2, the look-up tables LUT1, LUT2, LUT3, and LUT4 may correspond to the four groups, respectively. For instance, when the number of the gate lines GL1 to GLn is 1080, the look-up table LUT1 may correspond to the gate lines GL1 to GL270, the look-up table LUT2 may correspond to the gate lines GL271 to GL540, the look-up table LUT3 may correspond to the gate lines GL541 to GL810, and the look-up table LUT4 correspond may to the gate lines GL811 to GL1080. It other words, the number of look-up tables may be configured based on the number of divisions in the second direction X2 of the display panel 310.

According to exemplary embodiments, when the image signal RGB is the signal applied to the pixels PX connected to the gate line GL100, the kickback compensation part 220 may output the kickback compensation signal with reference to the look-up table LUT1. That is, based on the division in the second direction X2 in which a pixel PX is disposed, the kickback compensation part 220 may reference the corresponding look-up table associated with that division in the second direction X2 of the display panel 310, as well as reference the corresponding parts of the referenced look-up table to account for variations in the first direction X1. In other words, the kickback compensation part 220 may compensate not only for the variation of the kickback voltage in the first direction X1, but may also account for variation of the kickback voltage in the second direction X2 using the look-up tables LUT1, LUT2, LUT3, and LUT4.

Although not illustrated, it is also contemplated that each of the entries in the look-up tables LUT1, LUT2, LUT3, and LUT4 may correspond to multiple entries associated with a number of reference gate lines GL, such that an interpolation scheme may be utilized in a manner similar to that described in association with FIG. 7 to determine kickback compensation signals for pixels PX connected to gate lines other than the reference gate lines.

For example, a pixel PX may be connected to the gate line GL200 and the data line DL1 of the display panel 320. As described in association with FIG. 10, the kickback compensation part 220 may reference look-up table LUT1, and, thereby, utilize a kickback compensation value 255 as the kickback compensation signal. It is contemplated, however, that the look-up table LUT1 may include a number of entries respectively associated with reference gate lines, such as four entries associated with four reference gate lines GL1, GL90, GL180, and GL270 among the gate lines GL1 to GL 270 associated with the look-up table LUT1. As such, the kickback compensation part 220 may generate the kickback compensation signal of the aforementioned pixel PX by interpolating between the kickback compensation signals of two reference gate lines adjacent to the pixel PX, e.g., interpolate between the kickback compensation signals associated with reference gate lines GL180 and GL270. In this manner, the kickback compensation part 220 may be configured to interpolate kickback compensation signals with respect to both the first and second directions X1 and X2 of the display panel 310.

According to exemplary embodiments, the controller 330 may be configured substantially similar to the controller 130 of FIGS. 1 and 6; however, the controller 330 may reference multiple look-up tables (such as described in association with FIG. 10) versus the look-up table LUT associated with FIG. 7.

Figure 11:
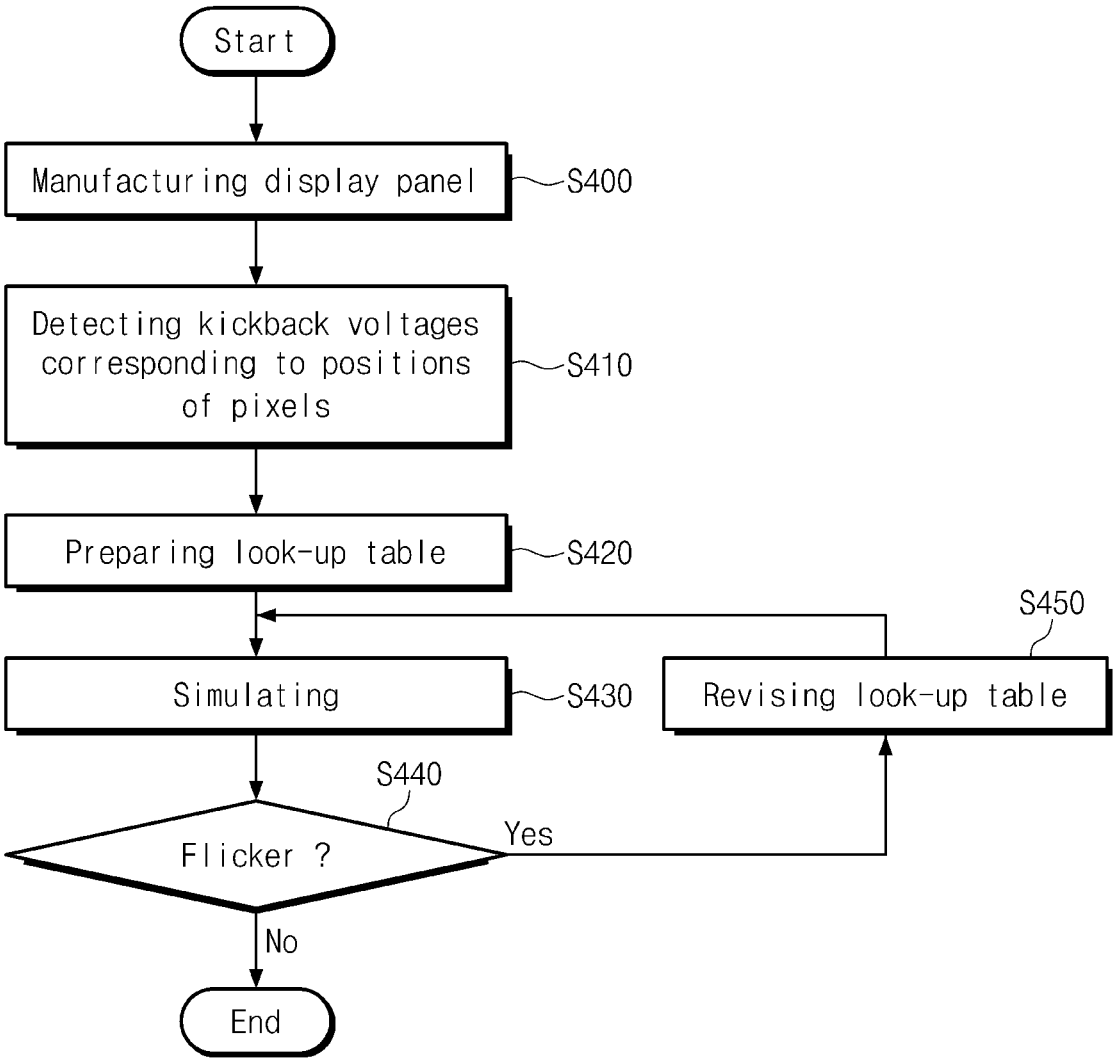
FIG. 11 is a flowchart of a method of manufacturing a display device, according to exemplary embodiments.

FIG. 11 is a flowchart of a method of manufacturing a display device, according to exemplary embodiments. For the purposes of descriptive convenience, the method of FIG. 11 is described in association with the display device 100 of FIGS. 1-7.

Referring to FIGS. 1 to 7 and 11, the display panel 110 is manufactured (S400). The kickback voltages corresponding to positions of the pixels PX included in the display panel 110 are detected (S410). The kickback voltages may be determined by measuring electric charge amounts accumulated in the liquid crystal capacitors of the pixels PX during one or more test operations. In this manner, the look-up table LUT stored in the memory 132 is prepared using the measured kickback voltages corresponding to the positions of the pixels PX (S420). The look-up table LUT stores the kickback compensation signals corresponding to the image signal RGB and the positions of the pixels in which the image signal RGB is displayed.

The operation of the display device 100 is simulated (S430). If a flicker occurs during simulation (S440), the look-up table LUT is revised (S450) and another simulation of the display device 100 is performed. The look-up table LUT may be revised to compensate for imbalance between the kickback voltages of the pixels PX, which may be caused by process errors generated when the display panel 110 is being manufactured, e.g., a line width discrepancy of the data and gate lines, an operational discrepancy of the thin film transistors, etc. If no flicker occurs, then the process ends.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device, comprising:

gate lines extending in a first direction;

data lines extending in a second direction crossing the first direction, some of the data lines corresponding to reference data lines and some of the data lines corresponding to non-reference data lines;

pixels, each pixel being connected to a corresponding gate line of the gate lines and a corresponding data line of the data lines;

a gate driver configured to drive the gate lines;

a data driver configured to drive each data line of the data lines in response to a corresponding data signal;

a memory configured to store kickback compensation values in association with the reference data lines; and a timing controller comprising a kickback compensation part, the timing controller being configured to, in response to an image signal and a control signal, apply the corresponding data signals to the data driver and control the gate driver, wherein each corresponding data signal reflects a kickback compensation value corresponding to a distance between the gate driver and the corresponding data line in the first direction, and wherein, for each non-reference data line of the non-reference data lines, the kickback compensation part is configured to:

receive, from the memory, kickback compensation values of reference data lines adjacent to the non-reference data line; and determine the corresponding data signal to be applied to the non-reference data line based on an interpolation between the received kickback compensation values.

2. The display device of claim 1, wherein the timing controller is configured to output the kickback compensation values stored in the memory as the corresponding data signals for the reference data lines.

3. The display device of claim 2, wherein the kickback compensation part is further configured to:

receive the kickback compensation values stored in the memory based on the image signal; and apply the received kickback compensation values to the data driver as the corresponding data signals for the reference data lines.

4. The display device of claim 1, wherein at least some of the reference data lines are spaced apart from one another by a number of the non-reference data lines.

5. The display device of claim 3, wherein the timing controller further comprises:

a color characteristic compensation part configured to compensate for a color characteristic of the kickback compensation values output from the kickback compensation part; and a response characteristic compensation part configured to output signals, in which a response speed is compensated for based on a difference between a present signal output from the color characteristic compensation part and a previous signal output from the color characteristic compensation part, as the corresponding data signals.

6. The display device of claim 1, wherein the kickback compensation values are inversely proportional to the distances between the gate driver and the corresponding data lines in the first direction.

7. The display device of claim 1, wherein:

the memory is further configured to store the kickback compensation values in association with groups of the gate lines; and the timing controller is further configured to:

receive the kickback compensation values of the reference data lines for each of the groups; and determine the corresponding data signal to be applied to the non-reference data line per group of the gate lines.

8. A method, comprising:

receiving a first signal associated with driving a pixel connected to a data line;

retrieving a first kickback voltage compensation value based on the first signal and the relative position of the data line with respect to a plurality of data lines;

retrieving a second kickback voltage compensation value based on the first signal and the relative position of the data line with respect to the plurality of data lines;

determining a third kickback voltage compensation value based on an interpolation between the first kickback voltage compensation value and the second kickback voltage compensation value; and generating a second signal based on the first kickback voltage compensation value and the third kickback voltage compensation value to drive the pixel via the data line.

9. The method of claim 8, wherein:

the first kickback voltage compensation value is stored in correspondence with the data line; and the first kickback voltage compensation value corresponds to the second signal.

10. The method of claim 8, wherein:

the pixel is connected to a gate line crossing the data line; and the first kickback voltage compensation value is further retrieved based on the relative position of the gate line with respect to a plurality of gate lines.

11. The method of claim 8, wherein:

the first kickback voltage compensation value is stored in correspondence with a first reference data line of the plurality of data lines;

the second kickback voltage compensation value is stored in correspondence with a second reference data line of the plurality of data lines; and the interpolation is performed based on the relative position of the data line between the first reference data line and the second reference data line.

12. The method of claim 8, further comprising:

generating a third signal based on color compensating the second signal; and generating a fourth signal based on a difference between the third signal and a previously generated third signal.

13. The method of claim 12, wherein the fourth signal is output as a data driving signal to drive the pixel.

14. The method of claim 8, wherein:

the pixel is connected to a gate line crossing the data line; and the first kickback voltage compensation value is inversely proportional to the distance along the gate line between the data line and a gate driver connected to the pixel via the gate line.

15. The method of claim 8, wherein the first signal comprises an image signal.

16. The method of claim 8, wherein the first kickback voltage compensation value is retrieved from a look-up table storing kickback voltage compensation values in relation to the plurality of data lines.

* * * * *